US006155862A

United States Patent [19]

Chiu et al.

[11] Patent Number: 6,155,862

[45] Date of Patent: Dec. 5, 2000

[54] COUPLED ELECTRICAL CONNECTOR ASSEMBLY WITH A LATCH DEVICE

[75] Inventors: Allen Chiu; Kelly Shih, both of Tu-Chen, Taiwan

[73] Assignee: Hon Hai Precision Ind. Co., Ltd., Taipei Hsien, Taiwan

[21] Appl. No.: 09/397,495

[22] Filed: Sep. 15, 1999

[30] Foreign Application Priority Data

Apr. 20, 1999 [TW] Taiwan ..... 88206063

[51] Int. Cl.[7] ..... H01R 13/627

[52] U.S. Cl. ..... 439/347

[58] Field of Search ..... 439/347, 345

[56] References Cited

U.S. PATENT DOCUMENTS

| | | | |
|---|---|---|---|
| 4,302,066 | 11/1981 | Newman et al. | 439/347 |
| 4,871,323 | 10/1989 | Ohsumi | 439/347 |
| 5,011,426 | 4/1991 | Colleran et al. | 439/347 |
| 5,637,009 | 6/1997 | Tsuji et al. | 439/347 |
| 5,639,255 | 6/1997 | Muzslay | 439/347 |

FOREIGN PATENT DOCUMENTS

| | | | |
|---|---|---|---|
| 294382 | 11/1989 | Japan | 439/347 |
| 294383 | 11/1989 | Japan | 439/347 |

*Primary Examiner*—Gary F. Paumen
*Attorney, Agent, or Firm*—Wei Te Chung

[57] ABSTRACT

A coupled electrical connector assembly comprises a male connector, a female connector and a latching device. The male connector forms an opening and a first recess in a side wall thereof in communication with the opening. The female connector is received in the opening of the male connector and forms a second recess in a side wall thereof. The latching device is received in and engages with the recesses of the male and female connectors. The latching device includes a body and a pair of caps formed on opposite ends of the body.

2 Claims, 8 Drawing Sheets

COUPLED ELECTRICAL CONNECTOR ASSEMBLY WITH A LATCH DEVICE

FIELD OF THE INVENTION

The present invention relates to a coupled electrical connector assembly, and especially to a coupled electrical connector assembly having a reliable latch device.

BACKGROUND OF THE INVENTION

An electrical connector assembly is used to mate with a complementary connector for transmitting signals. The connectors may comprise male and female connectors. The male and female connectors are often coupled together by engagement between contacts thereof. However, the male and female connectors may be easily disconnected when an external force is exerted thereon. Thus, a conventional coupled electrical connector assembly has securing means, such as disclosed in U.S. Pat. Nos. 5,380,217 and 5,425,650 and Taiwan Patent Application Nos. 83209007 and 84208281, to securely interlock the mated connectors.

Referring to FIG. 8, a conventional coupled electrical connector assembly 100 includes a male connector 102 and a female connector 104 mated with the male connector 102. The female connector 104 forms a protrusion 106 upwardly extending from a top surface 108 thereof. The mate connector 102 forms an aperture 110 in a top surface 112 thereof for engaging the protrusion 106 thereby preventing disconnection of the coupled electrical connector assembly 100 due to an external force.

However, the engagement between the protrusion 106 and the aperture 110 is easily broken by an incidentally applied external force. Thus, the conventional coupled electrical connector assembly 100 is unreliable.

SUMMARY OF THE INVENTION

Accordingly, an object of the present invention is to provide a coupled electrical connector assembly having a latching device for securely interlock a pair of electrical connectors thereof.

A coupled electrical connector assembly in accordance with the present invention comprises a male connector, a female connector and a latching device. The male connector includes an opening and a first recess in a side wall thereof in communication with the opening. The female connector is received in the opening of the male connector and forms a second recess in a side wall thereof. The latching device is received in and engages with the recesses of the male and female connectors when the connectors are mated.

In accordance with another aspect of the present invention, the male connector includes an opening and a through hole proximate a side wall thereof in communication with the opening. The female connector is received in the opening of the male connector and forms a through hole proximate a side wall thereof. The latching device is received in and engages with the through holes of the male and female connectors.

DESCRIPTION OF THE DRAWINGS

Other objects of the present invention can be concluded from the attached drawings and detailed description of the embodiments.

DETAILED DESCRIPTION OF THE EMBODIMENTS

Figure 1:
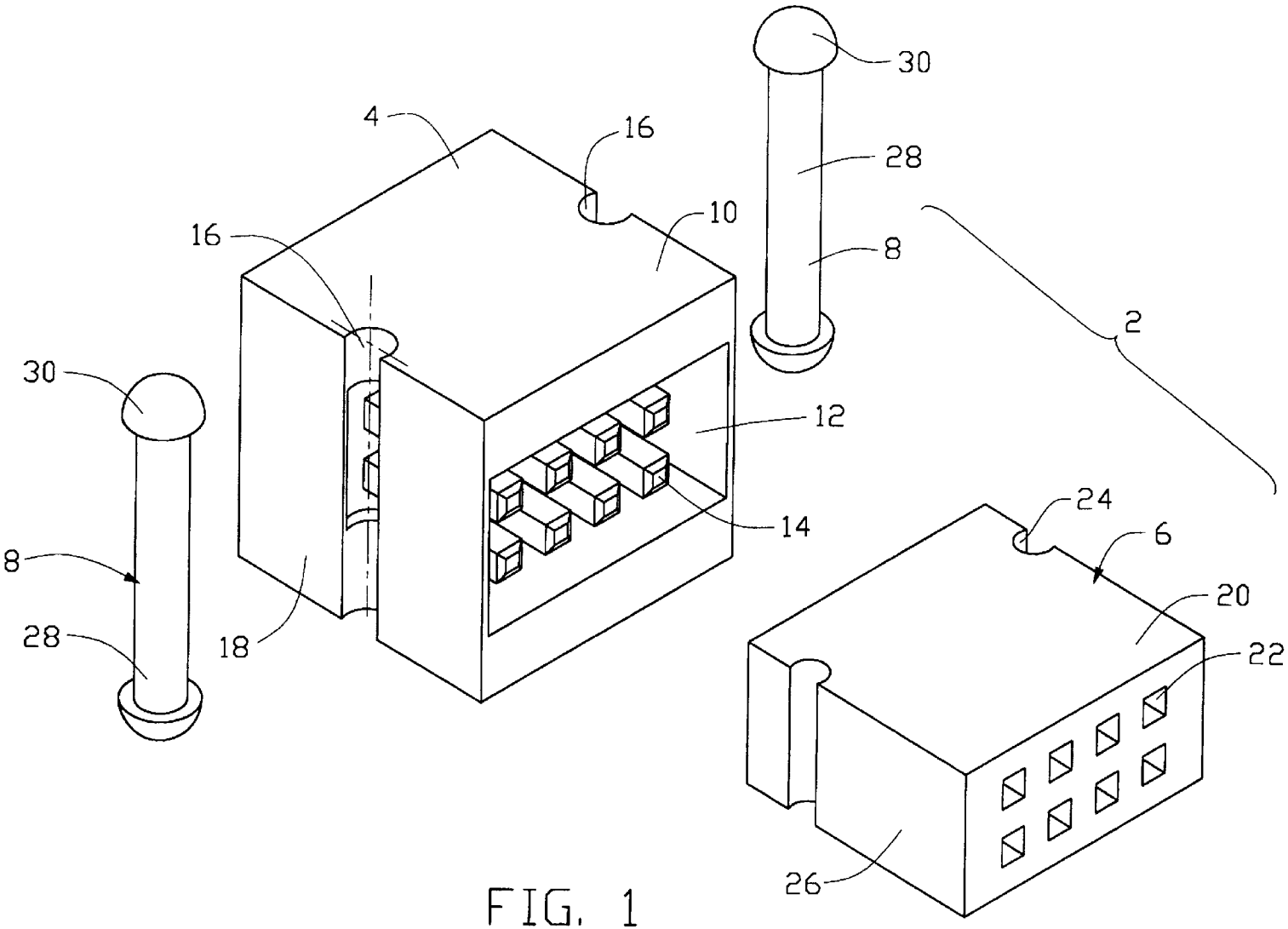
FIG. 1 is an exploded view of a coupled electrical connector assembly in accordance with a first embodiment of the present invention.
Figure 2:
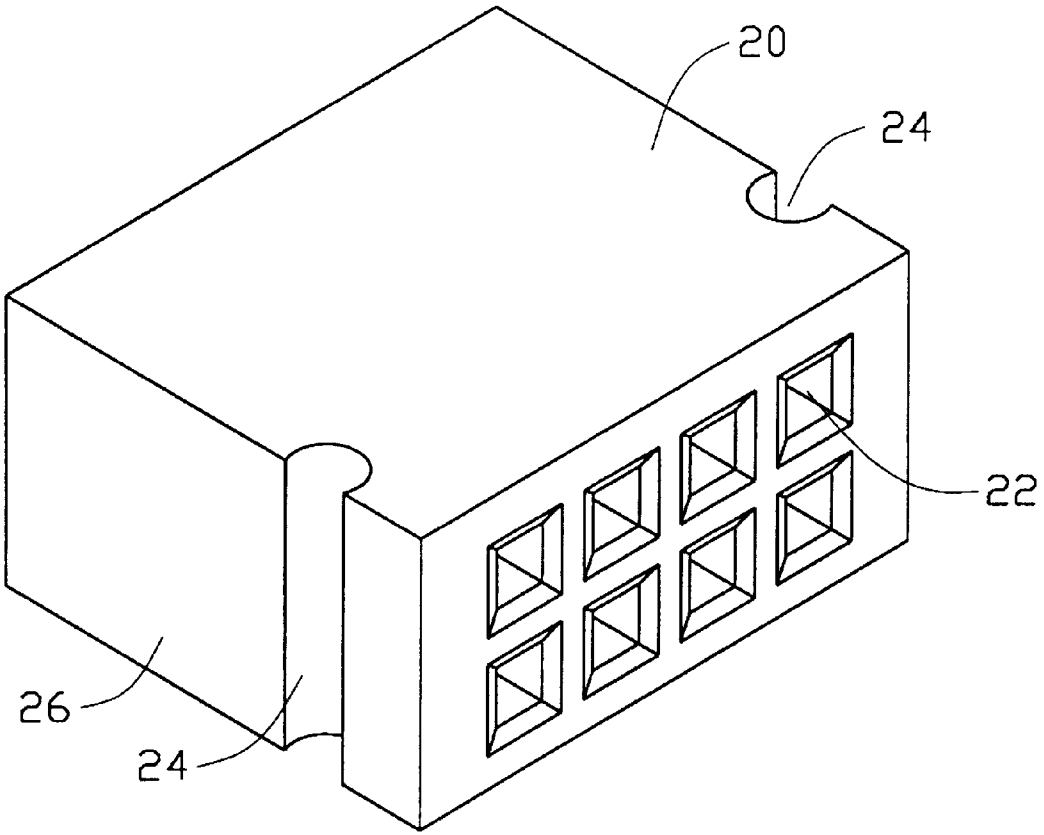
FIG. 2 is a perspective view of a female connector of the present invention.
Figure 3:
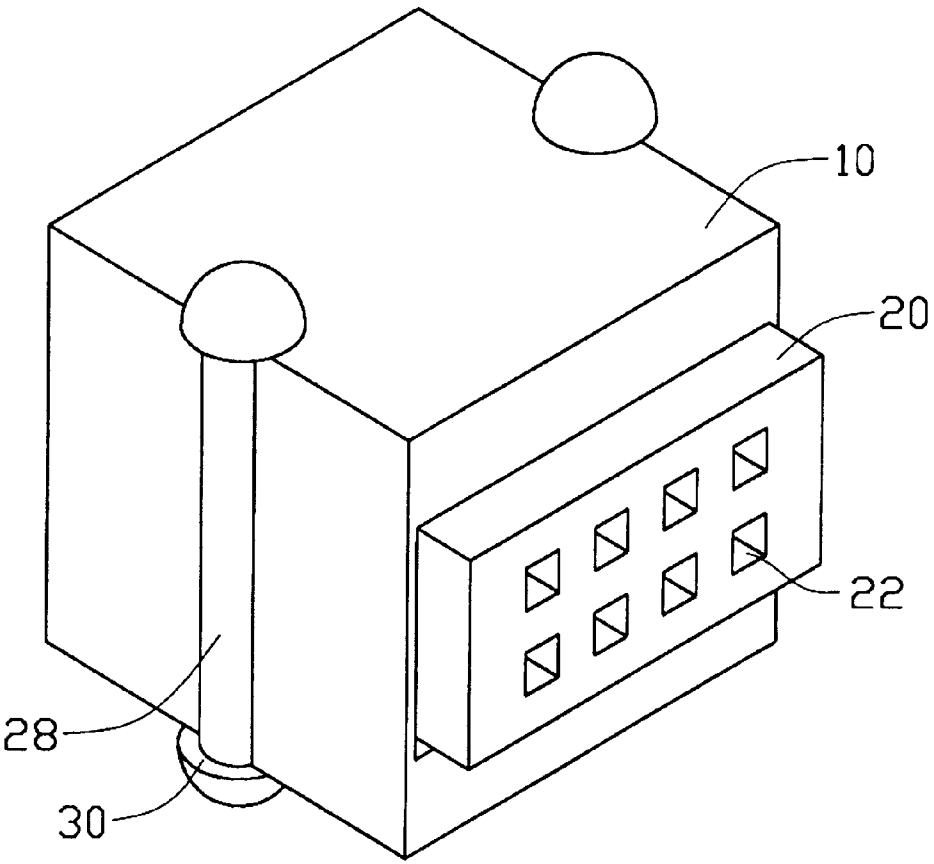
FIG. 3 is an assembled view of FIG. 1.

Referring to FIGS. 1–3, a coupled electrical connector assembly 2 in accordance with a first embodiment of the present invention comprises a male connector 4, a female connector 6 to be coupled with the male connector 4 and a pair of latching devices 8 attached to the male and female connectors 4, 6. The male connector 4 includes a rectangular housing 10 which forms a rectangular opening 12 and receives a plurality of contacts 14 therein. A pair of first recesses 16 is formed in opposite side walls 18 of the housing 10 in communication with the opening 12.

The female connector 6 includes a rectangular housing 20 for insertion into the opening 12 of the male connector 4 which forms a plurality of passageways 22 for insertion of the contacts 14 therein. A pair of second recesses 24 is formed in opposite side walls 26 of the housing 20. Each latching device 8 includes a body 28 and a pair of caps 30 attached to opposite ends of the body 28.

In the first embodiment, the first and second recesses 16, 24 are arcurate and have the same radius. The body 28 is cylindrical and has the same radius as the first and second recesses 16, 24 for securely engaging with the first and second recesses 16, 24. The first recess 16 has an arc slightly larger than a semicircle for securely receiving the body 28 of the corresponding latching device 8.

In assembly, the female connector 6 is inserted into the opening 12 of the male connector 4. Each second recess 24 communicates with the corresponding first recess 16. The latching device 8 is inserted into and engages with the first and second recesses 16, 24 for securely locking the coupled electrical connector assembly 2. Inner surfaces of the caps 30 of each latching device 8 abut against top and bottom surfaces of the housing 10 of the male connector 4. Thus, the coupled electrical connector assembly 2 cannot be disconnected by an incident force.

Figure 4:
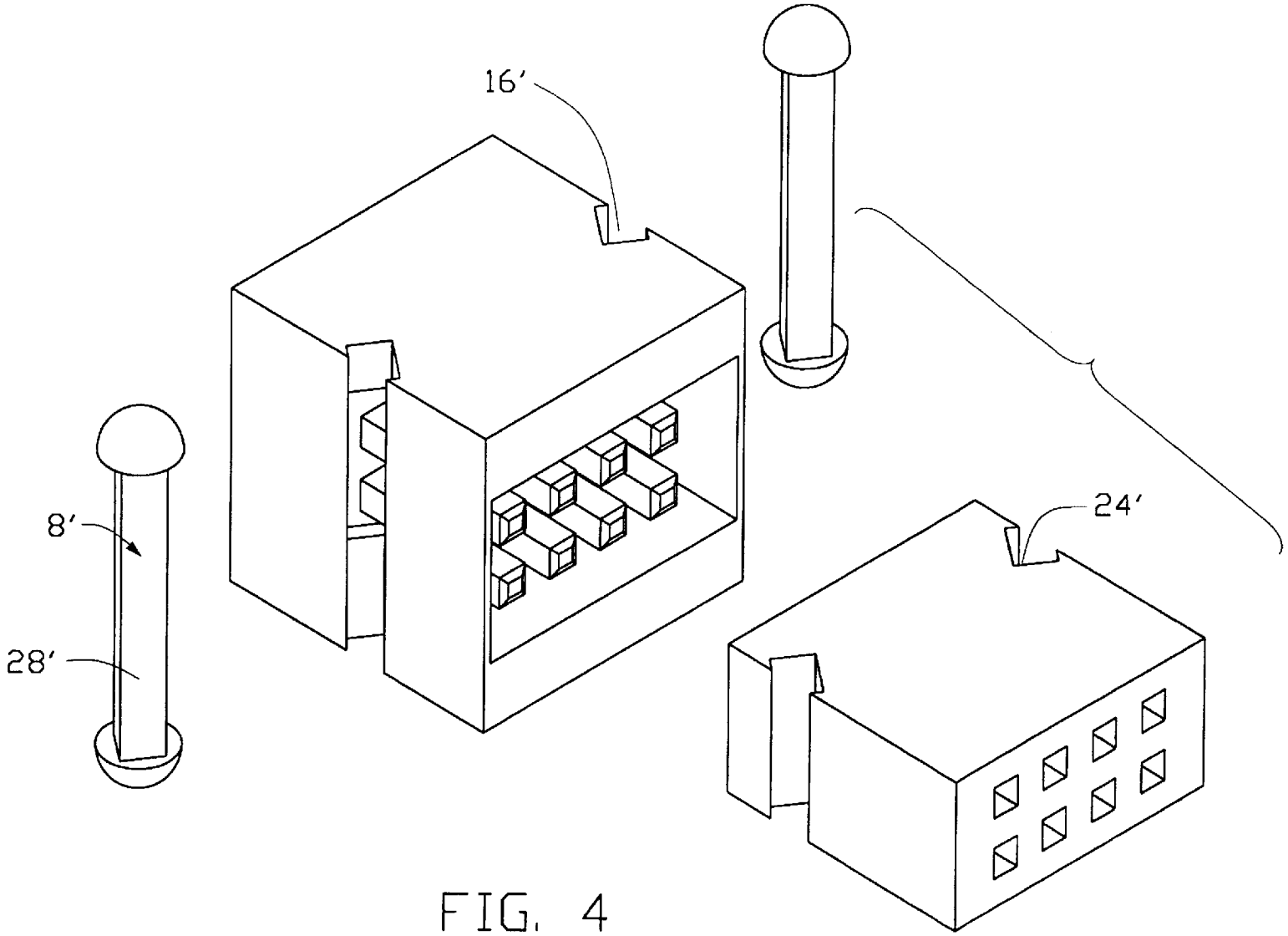
FIG. 4 is an exploded view of a coupled electrical connector assembly in accordance with a second embodiment of the present invention.
Figure 5:
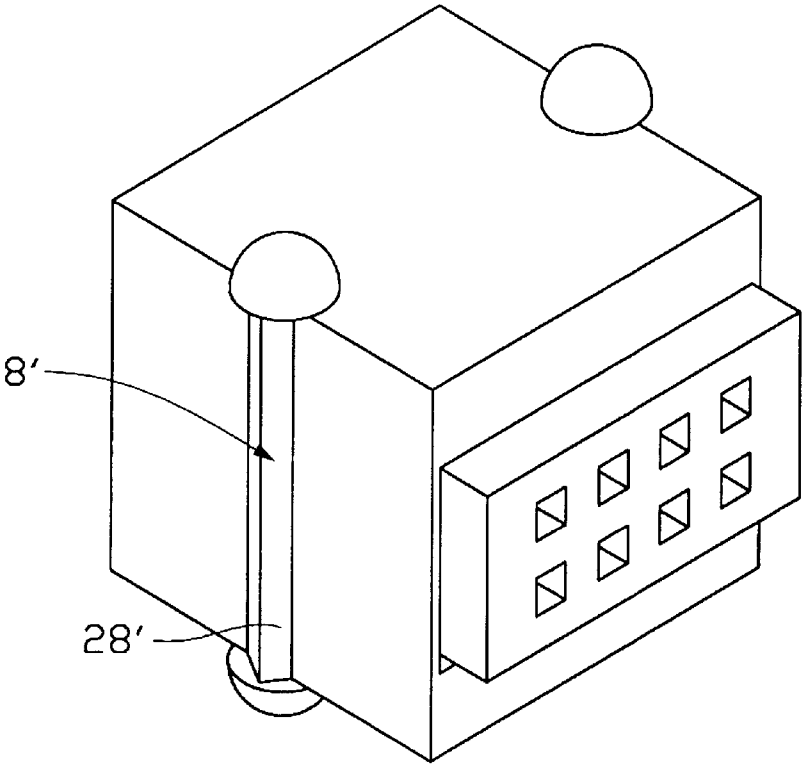
FIG. 5 is an assembled view of FIG. 4.

Referring to FIGS. 4 and 5, in a second embodiment of the present invention, the body 28' has a square cross section and the first and second recesses 16', 24' are dimensioned with a corresponding angular shape for insertion of and engagement with the body 28' of the latching device 8'.

Figure 6:
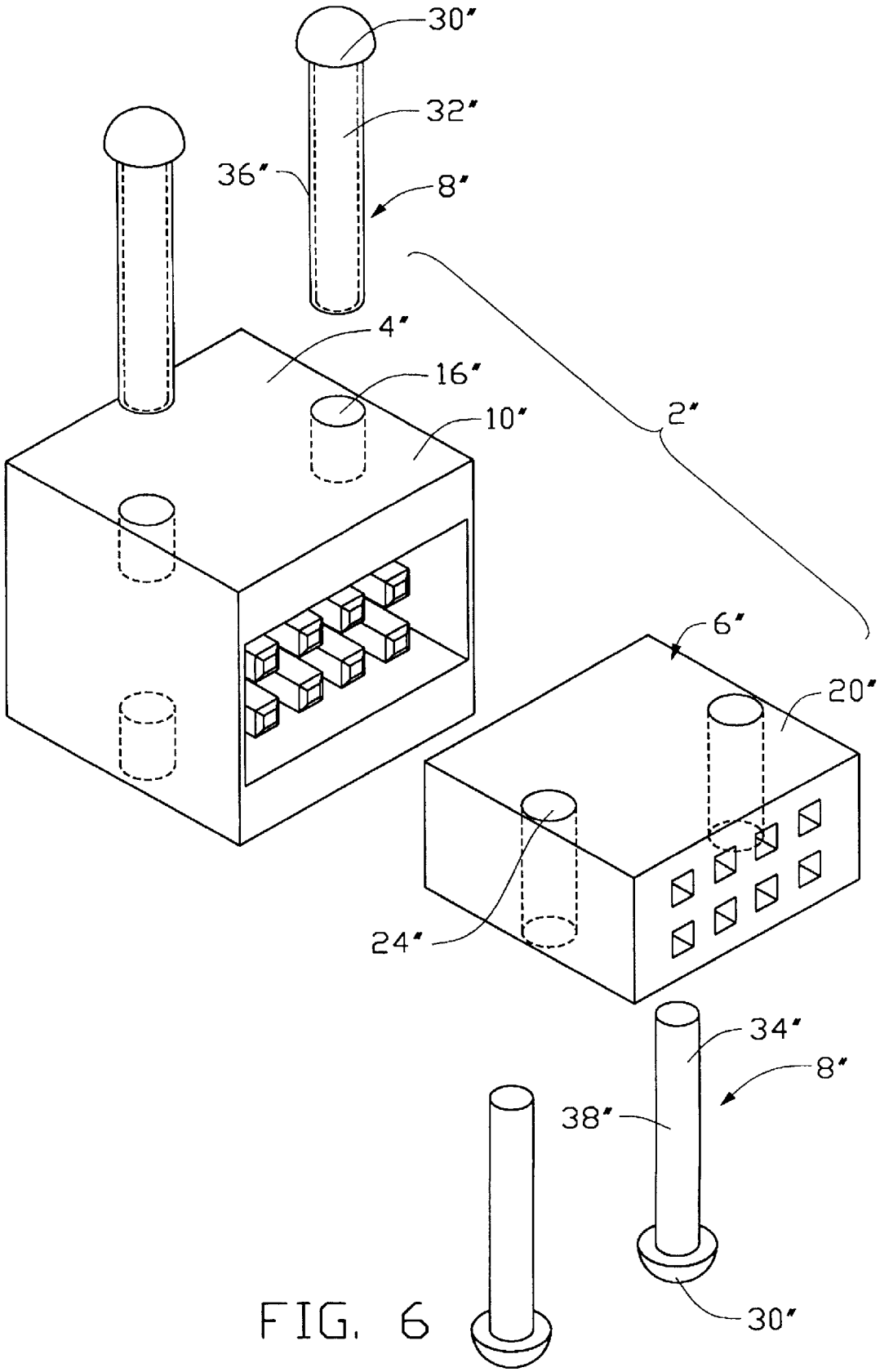
FIG. 6 is an exploded view of a coupled electrical connector assembly in accordance with a third embodiment of the present invention.
Figure 7:
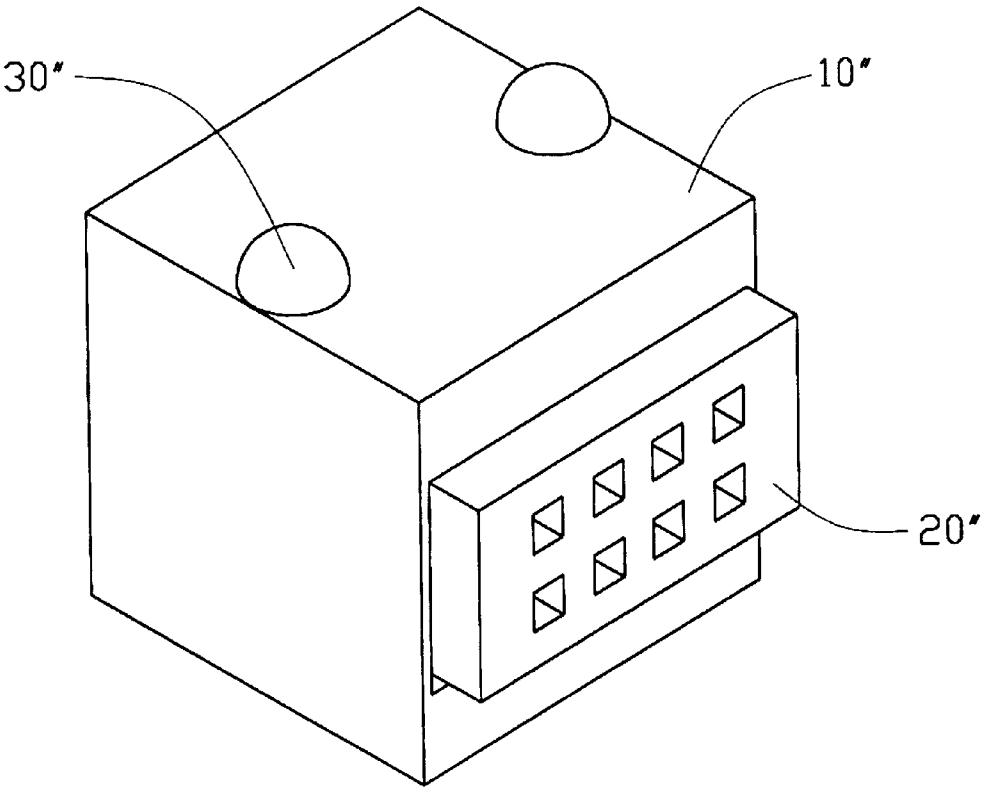
FIG. 7 is an assembled view of FIG. 6.
Figure 8:
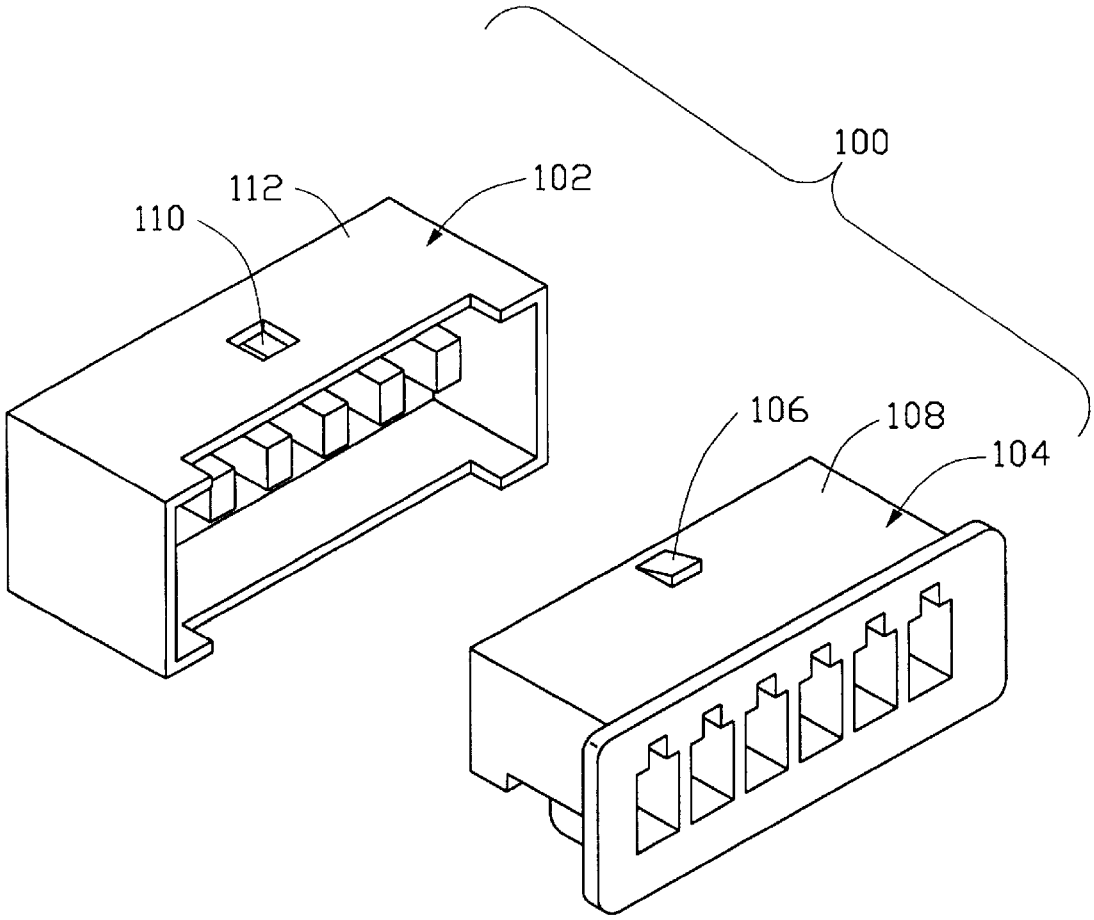
FIG. 8 (PRIOR ART)
FIG. 8 is an exploded view of a conventional coupled electrical connector assembly.

Referring to FIGS. 6 and 7, in a third embodiment of the present invention, the latching device 8" includes first and second latches 32", 34" each forming a cap 30" at a free end thereof. The first latch 32" includes a cylindrical body 36" with a hole formed therein (shown in dashed lines). The second latch 34" includes a body 38" for being interferentially inserted into the hole of the first latch 32". The housing 10", 20" of each male and female connector 4", 6" forms a pair of through hole 16", 24" proximate opposite sides thereof.

In assembly, the female connector 6" is inserted into the male connector 4" and the through holes 16", 24" are aligned with each other. The first latch 32" is inserted into and engages with the through holes 16", 24" and the second latch 34" is inserted into and engages with the hole of the first latch 32". Inner surfaces of the caps 30" of the first and second latches 32", 34" abut against top and bottom surfaces of the housing 10" of the male connector 4". Thus, the coupled electrical connector assembly 2" cannot be disconnected by an incident force.

Although the invention has been described in detail with reference to preferred embodiments, variations and modification exist within the scope and sprit of the present invention as described and defined in the following claims.

What is claimed is:

1. A coupled electrical connector assembly comprising:

a male connector forming an opening and a first recess in a side wall thereof in communication with the opening;

a female connector received in the opening of the male connector and forming a second recess in a side wall thereof; and a latching device received in and engaging with the recesses of the male and female connectors;

wherein the latching device includes a body and a pair of caps attached to opposite ends of the body;

wherein the first and second recesses are arcuate and wherein the body is cylindrical;

wherein the first recess has an arc slightly larger than a semicircle for securely receiving the body of the latching device.

2. A coupled electrical connector assembly comprising:

a male connector including an opening and a through hole proximate a side wall thereof in communication with the opening;

a female connector received in the opening of the male connector and forming a through hole proximate a side wall thereof; and a latching device received in and engaging with the through holes of the male and female connectors;

wherein the latching device includes first and second latches each having a cap at a free end thereof;

wherein the first latch includes a cylindrical body having a hole therein, and wherein the second latch includes a body for being interferentially inserted into the hole of the first latch.

* * * * *